US011654067B2

(12) United States Patent
Harper et al.

(10) Patent No.: US 11,654,067 B2
(45) Date of Patent: May 23, 2023

(54) MOBILITY AID

(71) Applicant: EASY AND LIGHT MOBILITY PTY LTD, Sydney (AU)

(72) Inventors: Christopher Patrick Harper, NSW (AU); David Charles Thompson, NSW (AU); Arthur David Cooper, NSW (AU); Thomas Maurice Fleming, NSW (AU)

(73) Assignee: Easy and Light Mobility Pty Ltd, Sydney (AU)

( * ) Notice: Subject to any disclaimer, the term of this patent is extended or adjusted under 35 U.S.C. 154(b) by 360 days.

(21) Appl. No.: 15/765,339

(22) PCT Filed: Oct. 4, 2016

(86) PCT No.: PCT/AU2016/000338
§ 371 (c)(1),
(2) Date: Apr. 2, 2018

(87) PCT Pub. No.: WO2017/054034
PCT Pub. Date: Apr. 6, 2017

(65) Prior Publication Data

US 2018/0280220 A1 Oct. 4, 2018

(30) Foreign Application Priority Data

Oct. 2, 2015 (AU) ..... 2015904021

(51) Int. Cl.
*A61G 7/10* (2006.01)

(52) U.S. Cl.
CPC ..... *A61G 7/1017* (2013.01); *A61G 7/1048* (2013.01); *A61G 7/1061* (2013.01); *A61G 7/1067* (2013.01); *A61G 2203/72* (2013.01)

(58) Field of Classification Search
CPC .. A61G 7/1017; A61G 7/1067; A61G 7/1048; A61G 7/1061; A61G 2203/72;
(Continued)

(56) References Cited

U.S. PATENT DOCUMENTS 1,588,573 A * 6/1926 Edmiston ..... A61G 7/1015 5/84.1
1,857,031 A * 5/1932 Schaffer ..... A61G 7/1019 5/86.1
(Continued)

FOREIGN PATENT DOCUMENTS

DE 29823115 U1 3/1999
EP 0555198 A1 8/1993
(Continued)

OTHER PUBLICATIONS

ProTech Medical, "Jazzy Select Power Chair, Pride Mobility", Jul. 21, 2009, Video (pp. 1 and 4) (Year: 2009).*
(Continued)

*Primary Examiner* — David R Hare
*Assistant Examiner* — Luke Hall
(74) *Attorney, Agent, or Firm* — The Law Office of Kevin McDermott, PLLC

(57) ABSTRACT

A mobility aid assembly which may be used for lifting and lowering a user. The assembly includes an articulated lifting arm releasably mounted to a base structure with a first portion of the lifting arm operable between a lowered position and a raised position by a linear actuator. A first end of the linear actuator is pivotally connected to a second portion of the lifting arm with the second end releasably mounted to a second upright portion of the lifting arm. The lower end of the linear actuator disengages from its mounting on the second upright portion when the first portion of
(Continued)

the lifting arm is lowered by the actuator to a position in which the first portion of the lifting impinges on the user.

8 Claims, 10 Drawing Sheets

(58) Field of Classification Search
CPC ..... A61G 1/04; E02F 3/3604; E02F 3/3609; E02F 3/369; F16L 27/1237
USPC ..... 5/87.1
See application file for complete search history.

(56) References Cited

U.S. PATENT DOCUMENTS 1,878,785 A * 9/1932 Leavitt ..... A61G 7/1015 5/86.1
1,889,925 A * 12/1932 Leininger ..... A61G 7/1055 5/89.1
2,050,269 A * 8/1936 Brooks ..... A61G 7/1015 5/84.1
2,339,007 A * 1/1944 Gahm ..... A61G 7/1046 297/5
2,361,102 A * 10/1944 Horne ..... A61G 7/1015 5/85.1
2,404,153 A * 7/1946 Wilhelm ..... B66D 3/24 74/625
2,439,163 A * 4/1948 Farmer ..... A61G 7/053 5/86.1
2,585,982 A * 2/1952 Wood ..... A61G 7/1074 254/99
2,630,231 A * 3/1953 Klinge ..... E02F 3/6273 414/715
2,650,725 A * 9/1953 Hoyer ..... A61G 3/06 414/549
2,663,386 A * 12/1953 Fenley ..... E21B 19/08 188/110
2,683,882 A * 7/1954 Smith ..... A61G 7/1046 5/86.1
2,809,381 A * 10/1957 Colaner, Sr. ..... A61G 7/1017 5/87.1
2,818,315 A * 12/1957 Limbach ..... A61G 7/1067 5/600
2,821,406 A * 1/1958 Hoyer ..... A61G 7/1046 280/657
2,903,238 A * 9/1959 Flandrick ..... A61G 7/1055 254/124
2,975,434 A * 3/1961 Butler ..... A61G 7/1046 5/86.1
2,991,485 A * 7/1961 Schulte ..... A61G 7/1046 5/87.1
3,104,399 A * 9/1963 Dalton ..... A61G 7/1076 4/562.1
3,131,404 A * 5/1964 Bowers ..... A61G 7/1046 5/86.1
3,203,009 A * 8/1965 Lundberg ..... A61G 7/1051 5/87.1
3,204,921 A * 9/1965 Ages ..... G05D 23/127 251/75
3,222,029 A * 12/1965 Hildemann ..... A61G 7/1074 254/8 R
3,252,704 A * 5/1966 Wilson ..... A61G 7/1051 482/68
3,270,574 A * 9/1966 Stewart ..... A61G 7/1017 74/98
3,304,059 A * 2/1967 Siliznoff ..... F15B 15/1471 254/93 R
3,357,427 A * 12/1967 Wittke ..... A61M 31/00 604/226
3,374,493 A * 3/1968 Herrera ..... A61G 7/1046 5/86.1
3,397,883 A * 8/1968 Kiehn ..... A61G 7/1017 482/67
3,473,174 A * 10/1969 Cool ..... A61G 7/1007 4/667
3,596,298 A * 8/1971 Durst, Jr. ..... A61G 7/1017 5/87.1
3,677,424 A * 7/1972 Anderson ..... A61G 7/1017 414/550
3,694,829 A * 10/1972 Bakker ..... A61G 7/1017 5/87.1
3,711,877 A * 1/1973 Averill ..... A61G 7/1015 5/87.1
3,815,163 A * 6/1974 Sullivan ..... A61G 7/1003 4/562.1
3,852,835 A * 12/1974 Whitaker ..... A61G 7/1003 4/562.1
3,877,421 A * 4/1975 Brown ..... A61G 7/1017 601/23
3,882,949 A * 5/1975 Anderson ..... A61G 5/045 180/8.2
3,962,737 A * 6/1976 James ..... A61G 7/1019 5/83.1
4,032,192 A * 6/1977 Jensen ..... B60P 1/26 298/23 A
4,092,748 A * 6/1978 Ewers ..... A61G 7/1017 5/85.1
4,104,748 A * 8/1978 Brisco ..... A61G 7/1017 5/611
4,133,061 A * 1/1979 Hurd ..... A47K 13/12 16/224
4,144,713 A * 3/1979 Clark ..... A61G 7/1017 60/477
4,255,823 A * 3/1981 Boyer ..... A61G 7/1007 280/47.16
4,305,623 A * 12/1981 Seabase ..... B60T 13/141 303/54
4,351,562 A * 9/1982 Twitchell ..... A61G 5/045 180/65.1
4,375,840 A * 3/1983 Campbell ..... A61G 5/045 180/6.5
4,407,030 A * 10/1983 Elliott ..... A61G 7/015 5/424
4,443,902 A * 4/1984 Baer ..... A61G 7/1017 280/304.1
4,452,102 A * 6/1984 Shaffer ..... F16H 1/32 475/169
4,483,653 A * 11/1984 Waite ..... B60N 2/245 280/250.1
4,538,853 A * 9/1985 Levenberg ..... A61G 5/14 297/337
4,554,691 A * 11/1985 Daugherty ..... A61G 7/1017 318/16
4,555,121 A * 11/1985 Lockard ..... A61G 3/06 280/30
4,573,736 A * 3/1986 Levenberg ..... A61G 5/14 297/337
4,658,451 A * 4/1987 Taniguchi ..... A61G 7/1057 5/607
4,661,035 A * 4/1987 Danielsson ..... A61G 3/062 414/550
4,664,584 A * 5/1987 Braun ..... A61G 3/06 187/217
4,680,819 A * 7/1987 James ..... A61G 7/1046 5/83.1
4,682,377 A * 7/1987 Reich ..... A61G 7/1017 5/83.1
4,690,457 A * 9/1987 Poncy ..... A61G 5/14 297/337
4,703,523 A * 11/1987 James ..... A61G 7/1017 5/83.1
4,704,749 A * 11/1987 Aubert ..... A61G 7/1019 280/250.1
4,712,257 A * 12/1987 James ..... A61G 7/1017 5/83.1
4,762,257 A * 8/1988 Spillers ..... A62B 35/0037 224/250
5,001,789 A * 3/1991 Schoenberger ..... A61G 7/1017 5/87.1

(56) References Cited

U.S. PATENT DOCUMENTS 5,022,106 A * 6/1991 Richards ..... A61G 7/1017 4/254
5,033,563 A * 7/1991 Brainerd, Jr. ..... G01G 19/445 177/132
5,077,844 A * 1/1992 Twitchell ..... A61G 7/1017 212/232
5,117,516 A * 6/1992 Penner ..... A61G 7/1017 5/81.1 R
5,142,709 A * 9/1992 McGuire ..... A61G 7/1007 4/667
5,149,310 A * 9/1992 Damino ..... F16H 1/2854 475/329
5,162,625 A * 11/1992 Comerford ..... H01H 3/166 200/61.89
5,201,377 A * 4/1993 Wilson ..... A61G 5/045 180/6.5
5,261,132 A * 11/1993 Bufford ..... A61G 7/1019 297/354.13
5,309,584 A * 5/1994 Parker ..... A61G 7/1017 5/86.1
5,312,157 A * 5/1994 Logan, Jr. ..... A61G 5/14 297/250.1
5,316,370 A * 5/1994 Newman ..... A61G 5/14 297/313
5,365,621 A * 11/1994 Blain ..... A61G 7/1017 5/83.1
5,411,044 A * 5/1995 Andolfi ..... A61G 7/1017 135/66
5,459,891 A * 10/1995 Reeve ..... A61G 7/1017 212/231
5,477,574 A * 12/1995 Skoe ..... A47K 3/12 135/65
5,502,851 A * 4/1996 Costello ..... A61H 3/04 482/69
5,511,256 A * 4/1996 Capaldi ..... A61G 7/1015 403/217
5,540,539 A * 7/1996 Wolfman ..... B60N 2/245 414/541
5,560,054 A * 10/1996 Simon ..... A61G 7/1017 5/83.1
5,630,236 A * 5/1997 Messin ..... A61G 7/1007 4/667
5,661,858 A * 9/1997 House ..... A61G 7/1007 4/667
5,672,849 A * 9/1997 Foster ..... A61G 7/1017 177/144
5,692,253 A * 12/1997 Keijser ..... A61G 7/1017 5/83.1
5,758,371 A * 6/1998 VanDyke ..... A61G 7/1015 5/86.1
5,784,729 A * 7/1998 Dunn ..... A61G 7/1017 5/86.1
5,790,995 A * 8/1998 Caden ..... A61G 7/1005 4/491
5,815,859 A * 10/1998 Lavin ..... A61G 7/1017 5/89.1
5,845,348 A 12/1998 Dunn et al.
5,892,180 A * 4/1999 Carey ..... A61G 7/1017 177/144
6,035,462 A * 3/2000 Bennett ..... A61G 7/1007 4/254
6,042,330 A * 3/2000 Egan ..... A61G 7/1017 212/237
6,047,418 A * 4/2000 Seide ..... A61G 7/1015 5/81.1 R
6,067,674 A * 5/2000 Moser ..... A47K 17/026 4/254
6,092,247 A * 7/2000 Wilson ..... A61G 7/1061 5/81.1 R
6,119,287 A * 9/2000 Phillips ..... A61G 7/1017 5/81.1 RP
6,135,131 A * 10/2000 Downing ..... A61G 7/10 135/67
6,203,044 B1 * 3/2001 Conaway ..... A61G 3/0209 280/304.1
6,219,862 B1 * 4/2001 Horcher ..... A61G 7/1017 5/81.1 R
6,289,534 B1 * 9/2001 Hakamiun ..... A61G 7/1017 5/83.1
6,430,761 B1 * 8/2002 Brandorff ..... A61G 7/053 5/81.1 R
6,449,783 B1 * 9/2002 Moser ..... A61G 7/1094 4/667
6,507,961 B1 * 1/2003 Ming-Hwa ..... A61G 5/14 297/DIG. 10
6,640,365 B1 * 11/2003 Chang ..... A61G 7/015 5/616
6,694,545 B1 * 2/2004 Renton ..... A61G 7/1019 212/901
6,775,858 B1 * 8/2004 Miller ..... A61G 5/1002 280/250.1
7,021,713 B2 * 4/2006 Kao ..... A61G 5/14 297/338
7,506,388 B1 * 3/2009 Brown ..... A61G 7/1017 5/86.1
7,543,876 B1 * 6/2009 Egan ..... A61G 7/1017 296/63
7,611,203 B1 * 11/2009 Roberts ..... A61G 7/1011 297/217.7
7,669,255 B2 * 3/2010 Raney ..... A61G 7/1017 5/86.1
7,690,056 B2 * 4/2010 Moffa ..... A61G 7/1017 5/84.1
7,726,014 B2 * 6/2010 Wada ..... G02B 7/00 29/729
8,060,958 B1 * 11/2011 Hough ..... A61G 7/1017 5/83.1
8,104,835 B2 * 1/2012 Ovre ..... A61G 5/127 297/340
8,123,664 B2 * 2/2012 Lokken ..... A61G 5/14 297/311
8,398,356 B2 * 3/2013 Sandoz ..... A61G 3/0808 414/541
8,572,811 B2 * 11/2013 Lautenschlager ..... E05D 3/14 16/370
8,579,349 B1 * 11/2013 Schlangen ..... B60N 2/809 296/63
8,646,119 B1 * 2/2014 Sheridan ..... A61G 7/1005 4/496
8,856,981 B1 * 10/2014 Rayess ..... A61G 7/1011 5/83.1
9,358,166 B2 * 6/2016 Ferniany ..... A61G 5/12
9,597,240 B2 * 3/2017 Hermanson ..... A61G 3/061
9,945,093 B1 * 4/2018 Belliveau ..... E02F 3/369
10,426,677 B2 * 10/2019 Ferniany ..... A61G 5/121
10,470,951 B2 * 11/2019 Kitchin ..... A61G 3/062
2001/0047542 A1 * 12/2001 Luckenbill ..... A61G 7/1094 4/668
2002/0002740 A1 * 1/2002 Schroeter ..... A61G 7/1061 5/86.1
2002/0069461 A1 * 6/2002 Egan ..... A61G 7/1067 5/81.1 R
2002/0138904 A1 * 10/2002 Wong ..... A61G 7/0513 5/600
2002/0184760 A1 * 12/2002 Babin ..... H02K 5/00 29/888
2003/0000013 A1 * 1/2003 Schroeter ..... A61G 7/1061 5/86.1
2003/0070227 A1 * 4/2003 Schroeter ..... A61G 7/1061 5/86.1
2003/0137119 A1 * 7/2003 Razon ..... A61H 3/008 280/87.021
2003/0208844 A1 * 11/2003 Moffa ..... A61G 7/1067 5/86.1
2004/0006819 A1 * 1/2004 Johansson ..... A61G 7/1051 5/81.1 R

(56) References Cited

U.S. PATENT DOCUMENTS

2004/0148699 A1* 8/2004 Fernie ..... A61G 7/1061 5/86.1
2004/0158920 A1* 8/2004 Walling ..... A47C 31/002 5/2.1
2004/0163173 A1* 8/2004 Downing ..... A61G 7/1094 5/86.1
2004/0177441 A1* 9/2004 Ronne ..... A61G 7/1017 5/86.1
2004/0232395 A1* 11/2004 Brooks ..... A61G 7/1011 254/8 R
2004/0232396 A1* 11/2004 Ming-Hwa ..... A61G 7/1076 254/8 R
2005/0006631 A1* 1/2005 Ming-Hwa ..... A61G 7/1076 254/8 R
2005/0011003 A1* 1/2005 Davis ..... A61G 7/1051 5/83.1
2005/0034231 A1* 2/2005 Huang ..... A61G 7/1046 5/86.1
2005/0097670 A1* 5/2005 Hawk ..... A61G 7/1017 5/84.1
2005/0102754 A1* 5/2005 Barthelt ..... A61G 7/0528 5/618
2005/0132495 A1* 6/2005 Girard ..... A61G 1/01 5/625
2005/0173216 A1* 8/2005 Meernik ..... B60R 19/40 188/371
2005/0189798 A1* 9/2005 Strong ..... B60B 33/0039 297/183.7
2006/0026755 A1* 2/2006 Bain ..... A61G 7/1074 5/86.1
2006/0045708 A1* 3/2006 Bain ..... A61G 7/1046 414/620
2006/0045709 A1* 3/2006 Bain ..... A61G 7/1067 414/626
2006/0048294 A1* 3/2006 Maguire ..... A61G 7/1094 4/496
2006/0048297 A1* 3/2006 Mills ..... A61G 7/1067 5/86.1
2008/0134433 A1* 6/2008 Maciejewski ..... A61G 13/02 5/601
2009/0094748 A1* 4/2009 Long ..... A47C 20/041 5/613
2009/0126104 A1* 5/2009 Lukasiak ..... A61G 7/1017 5/83.1
2009/0144895 A1* 6/2009 Bostelman ..... A61G 7/1088 5/87.1
2009/0165203 A1* 7/2009 Biersteker ..... A61G 7/1074 5/83.1
2009/0165204 A1* 7/2009 Biersteker ..... A61G 7/1074 5/87.1
2009/0249544 A1* 10/2009 Palay ..... A61G 7/1017 5/83.1
2010/0031439 A1* 2/2010 Spidare ..... A61G 7/1069 5/87.1
2010/0064431 A1* 3/2010 Kawakami ..... A61G 7/1046 5/81.1 RP
2010/0107329 A1* 5/2010 Nelson ..... B60B 33/04 5/87.1
2010/0125947 A1* 5/2010 Manson ..... A61G 7/053 5/83.1
2010/0132114 A1* 6/2010 Becker ..... A61G 7/1046 5/87.1
2010/0224841 A1* 9/2010 Liljedahl ..... B66C 23/48 254/120
2011/0016628 A1* 1/2011 Masterson, Jr. ..... A61G 7/1015 5/87.1
2011/0035058 A1* 2/2011 Clough ..... G10L 17/00 700/275
2011/0043062 A1* 2/2011 Lorenzen ..... F16H 25/2454 310/83
2011/0083266 A1* 4/2011 Herron ..... A61G 7/1046 5/83.1
2011/0110715 A1* 5/2011 Andreasen ..... B66D 3/26 403/326
2011/0138532 A1* 6/2011 Lin ..... A61G 7/1046 5/86.1
2011/0238217 A1* 9/2011 Kume ..... A61G 7/1017 700/275
2011/0289681 A1* 12/2011 Biersteker ..... A61G 7/1046 5/86.1
2011/0302711 A1* 12/2011 Biersteker ..... A61G 7/1046 5/87.1
2012/0023661 A1* 2/2012 Ota ..... A61G 7/1048 5/86.1
2012/0047648 A1* 3/2012 Purwar ..... A61H 3/04 5/86.1
2012/0205401 A1* 8/2012 Litten ..... B05B 11/3052 222/252
2012/0240333 A1* 9/2012 Niklasson ..... A61G 7/1061 5/83.1
2012/0317715 A1* 12/2012 Corriveau ..... A61G 7/1067 5/86.1
2013/0111660 A1* 5/2013 Wilson ..... A61G 7/1019 5/86.1
2013/0160268 A1* 6/2013 Parker ..... E02F 3/3668 29/428
2014/0013499 A1* 1/2014 Steinman ..... A61G 7/1059 4/496
2014/0068855 A1* 3/2014 Grow ..... B66C 23/48 5/87.1
2014/0109312 A1* 4/2014 Gray ..... A61G 7/1098 5/86.1
2014/0182059 A1* 7/2014 Jonsson ..... A61G 7/1055 5/89.1
2014/0346745 A1* 11/2014 Ganel ..... A61G 5/1002 280/47.4
2015/0190293 A1* 7/2015 Hacikadiroglu ..... A61G 7/1017 5/87.1
2016/0228313 A1* 8/2016 Rogge ..... A61G 7/1076
2017/0281368 A1* 10/2017 Gill ..... A61F 2/585
2019/0277395 A1* 9/2019 Yoshimura ..... F16H 57/0495
2019/0330031 A1* 10/2019 Walker ..... B66C 1/12
2019/0343660 A1* 11/2019 Gill ..... A61F 2/68

FOREIGN PATENT DOCUMENTS

EP 0695159 B1 3/1997
EP 1269960 A2 1/2003
EP 1300127 A2 4/2003
GB 2277302 A 10/1994
JP H10-286290 A 10/1998
JP H10286290 A * 10/1998 ..... A61G 7/10
WO 9001916 A1 3/1990
WO 2004058126 A1 7/2004
WO 2012130930 A1 4/2012
WO 2014075679 A8 5/2014

OTHER PUBLICATIONS

"Dolphin mobility"; Dolphin Stair Lifts—Supplier of Lifts and Stairlifts in the UK; Mar. 29, 2018; 3 pages; http://www.dolphinlifts.co.uk/?id=pgIz2VXI.
"MultiLift550 SystemRoMedic"; 4 pages; www.handicare.com.
Examination Report for EPO Application No. 16849941.6-1113, dated Nov. 30, 2021, pp. 1-3.

* cited by examiner

MOBILITY AID

CROSS-REFERENCE TO RELATED APPLICATIONS

This application is a U.S. national phase entry under 35 U.S.C. § 371 of International Application No. PCT/AU2016/000338, filed on Oct. 4, 2016, which claims priority to Australian Patent Application No. 2015904021, filed on Oct. 2, 2015. Each of these patent applications is incorporated by reference herein in its entirety.

TECHNICAL FIELD

The present invention relates to devices for movement of incapacitated individuals and, more particularly to mobile devices which may transport a user from one location to another.

BACKGROUND

Mobility aids in the form of hoists which allow a carer to lift and lower an incapacitated person, are well known. These devices are particularly used both in hospitals and in domestic situations for transfer of a person from, for example, a wheelchair onto a bed and vice versa.

Hoists range in complexity from a relatively simple frames mounted on castors and fitted with a ram-driven lifting arm, such as for example shown in www.dolphin-lifts.co.uk/Suas_Hoists.html, to highly complex motor driven devices such as shown in http://www.activemedicalsupplies.com.au/Products/Multilift550 MotorisedPatient-Lifter.aspx While the simpler devices are relatively light weight and may even allow of disassembly for transport, a problem with castor mounted devices is the difficulty of manoeuvring them on any other than a hard smooth surface. Thus, on carpet where the generally small castors sink into the pile, moving the lifter in any direction can be very difficult and, especially when trying to move such a device laterally from a previous straight ahead movement, may even lead to the tipping over of the device.

The highly sophisticated devices such as that of Active Medical Supplies referenced above are very heavy, expensive and really only suitable for hospital or other health establishment use and are clearly not portable.

The rams used to raise and lower the articulated lifting arms of hoists are generally capable of exerting a force of 1300N, both in extension and in retraction. A safety issue arises if the carer is distracted, or there is a malfunction in the switching system during the lowering of a user when the ram is retracting, since the lifting arm may deliver a crushing force to the user's head and shoulders.

Typically hoists are constructed with a forward directed fork extending from a rear cross member and spaced apart sufficient for stability and moving the hoist through doorways. It is a common feature of known hoists to provide for a spreading or splaying of the two members of the fork to allow a wheelchair to move between them so as to bring the user directly under the end of the lifting arm. Splaying of the fork is typically achieved by manually pumping a pneumatic cylinder or manipulating a lever to activate a spreading mechanism. In both arrangements this can be very difficult, particularly so when the hoist is positioned on deep pile carpet.

It is an object of the present invention to address or at least ameliorate some of the above disadvantages or provide a useful alternative.

NOTES

The term "comprising" (and grammatical variations thereof) is used in this specification in the inclusive sense of "having" or "including", and not in the exclusive sense of "consisting only of".

The above discussion of the prior art in the Background of the invention, is not an admission that any information discussed therein is citable prior art or part of the common general knowledge of persons skilled in the art in any country.

SUMMARY OF INVENTION

Accordingly in one broad form of the invention there is provided a mobility aid assembly for lifting and lowering a user; the assembly including an articulated lifting arm releasably mounted to a base structure; a first portion of the lifting arm operable between a lowered position and a raised position by a linear actuator; a first end of the linear actuator pivotally connected to the first portion of the lifting arm and, wherein a second end of the linear actuator is releasably mounted so as to avoid injury to the user if the linear actuator moves the first portion of the lifting arm to an excessively lowered position in which the first portion of the lifting impinges on the user.

Preferably the second end of the linear actuator is provided with a mounting boss; the boss provided with a first connecting element for releasable connection to a complementary second connecting element provided on a second, fixed upright portion of the lifting arm.

Preferably the mounting boss comprises a body provided with a transverse slot; the complementary connecting element comprising a transverse support pin located on the second, fixed upright portion of the lifting arm; the slot slidingly engaging with the transverse support pin when the assembly is in use.

Preferably the mounting boss disengages from the second connecting element when an upward force acting on the first portion of the lifting arm exceeds the combined weight of the first portion of the lifting arm and that of the linear actuator.

Preferably the base structure comprises a hollow body provided at each outer end with a drive wheel; each drive wheel driven by respective electric motor modules located within the hollow body.

Preferably each electric motor module includes a gear train to reduce the RPM of the electric motor to a predetermined RPM of the drive wheel.

Preferably each electric motor is controllable for synchronized rotation of the wheels for forward and rearward movement of the assembly and for contra-rotation of the wheels for rotation of the assembly about a vertical axis.

Preferably the assembly further includes a forwardly directed fork; the fork comprising two fork elements extending from the base structure; each outer end of a fork element provided with a swivelling castor; each castor provided with a locking system for locking the direction of movement of the castor at a desired angle relative to a horizontal centerline of the assembly.

Preferably each of the fork elements is releasably mounted to the base structure; each of the fork elements arranged for rotation about a respective vertical axis at the base structure; each fork element rotatable between a first direction parallel to the centerline of the assembly and a second splayed direction wherein the separation between the outer ends of the fork elements is greater than the separation of the vertical axes at the base structure.

Preferably the fork elements move from the first direction parallel to the centreline to the splayed direction if the castor at each outer end of the fork element is locked at a "toed out" angle relative a centerline of the respective fork element and the assembly is driven in a forward direction; the fork elements returning to the first direction when the assembly is driven in a rearward direction with the castors locked in the "toed out" angle.

Preferably the articulated lifting arm is provided with connector elements at a lower end of the second, fixed upright portion of the lifting arm; the connector elements including tabs provided with forwardly directed slots; the tabs inserted through slots in the upper surface of the support structure for connecting the lifting arm to the base structure; the forwardly directed slots of the connector elements engaging with a transverse pin mounted within the hollow body of the base structure.

Preferably a rear surface at the lower end of the second, fixed upright portion of the lifting arm is provided with a securing plate; the securing plate extending to below a lower edge of the second, fixed upright portion of the lifting arm and provided with apertures for engagement with pins projecting from a rear surface of the support structure.

Preferably one of the projecting pins is provided with an internally threaded hole; the internally threaded hole adapted to receive an externally threaded shaft of a securing knob for locking the lifting arm in position on the base structure.

In a further broad form of the invention there is provided components for assembly into a transportable disability aid; the components comprising a base structure, an articulated lifting arm assembly and two fork elements; the lifting arm assembly including a first portion operable between a raised position and a lowered position; characterized in that a second end of a linear actuator of the lifting arm assembly is adapted for releasable connection to a second, fixed upright portion of the lifting arm assembly so as to avoid injury to a user if the linear actuator moves the first portion of the lifting arm to an excessively lowered position.

Preferably the base structure is provided at each outer end with a driven wheel; each wheel driven by an electric motor module.

Preferably the articulated lifting arm assembly includes the first portion pivotally connected to the second, fixed upright portion and a linear actuator pivotally connected to the first portion of the articulated lifting arm at a first end of the linear actuator.

Preferably the lifting arm assembly the second end of the linear actuator is disconnected from a connecting element located on the second, fixed upright portion of the articulated lifting arm.

Preferably each of the two fork elements is rotatably and releasably mountable to the base structure at inner ends of the fork element; the fork elements rotatable about respective vertical axes between a parallel position and a splayed position wherein separation between outer ends of the fork elements is greater than the separation of the vertical axes.

Preferably the outer end of each fork element is provided with a swivelling castor; each swivelling castor provided with a locking mechanism for locking the direction of the castor at a desired angle.

In a further broad form of the invention there is provided a method of changing disposition of fork elements of a fork of a disability aid assembly from a first position in which the fork elements are parallel to a horizontal centerline of the disability aid assembly and a second position in which outer ends of the fork elements are more widely separated than inner ends of the fork elements; the method including the steps of:

providing swivelling castors at the outer ends of the fork elements with locking mechanisms, locking each castor at an angle in which the direction of the castor is "toed out" relative to a centerline of the fork element, moving the disability aid assembly in a forward direction to drive the fork elements from the first position into the second position, moving the disability aid assembly in a rearward direction to drive the fork element from the second position into the first position, and wherein In yet a further broad form of the invention there is provided a method of avoiding injury to a user of a disability aid assembly if a first articulated portion of a lifting arm of the assembly is lowered by a linear actuator of the assembly to a point at which the first articulated portion is driven into contact with the user by retraction of the linear actuator; the method including the step of providing a lower end the linear actuator with a releasable mounting, and wherein a force acting on the user by an end of the articulated portion of the lifting arm cannot exceed a combined weight of the articulated portion of the lifting arm and the linear actuator.

BRIEF DESCRIPTION OF DRAWINGS

Embodiments of the present invention will now be described with reference to the accompanying drawings wherein.

DESCRIPTION OF EMBODIMENTS

Figure 1:
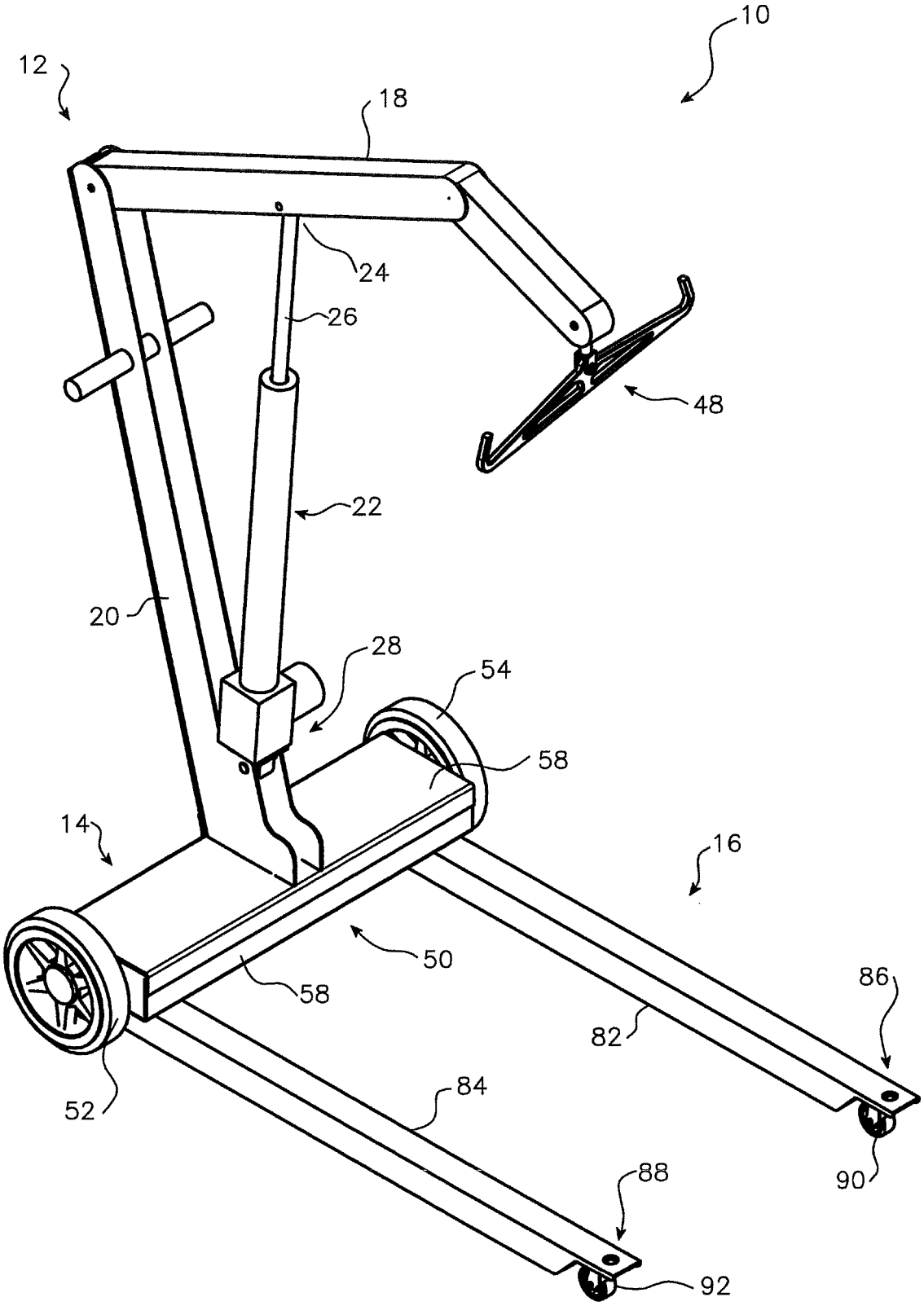
FIG. 1 is a perspective view of a mobility aid assembly according to a preferred embodiment of the invention.

With reference to FIG. 1, a mobility aid assembly 10 according to the invention, for lifting and lowering a disabled user (not shown), includes an articulated lifting arm 12 releasably mounted to a base structure 14 and a fork 16 extending from the base structure. A hanger 48 is suspended from the end of the lifting arm for attachment of slings or seating (not shown) for lifting a user.

Figure 2:
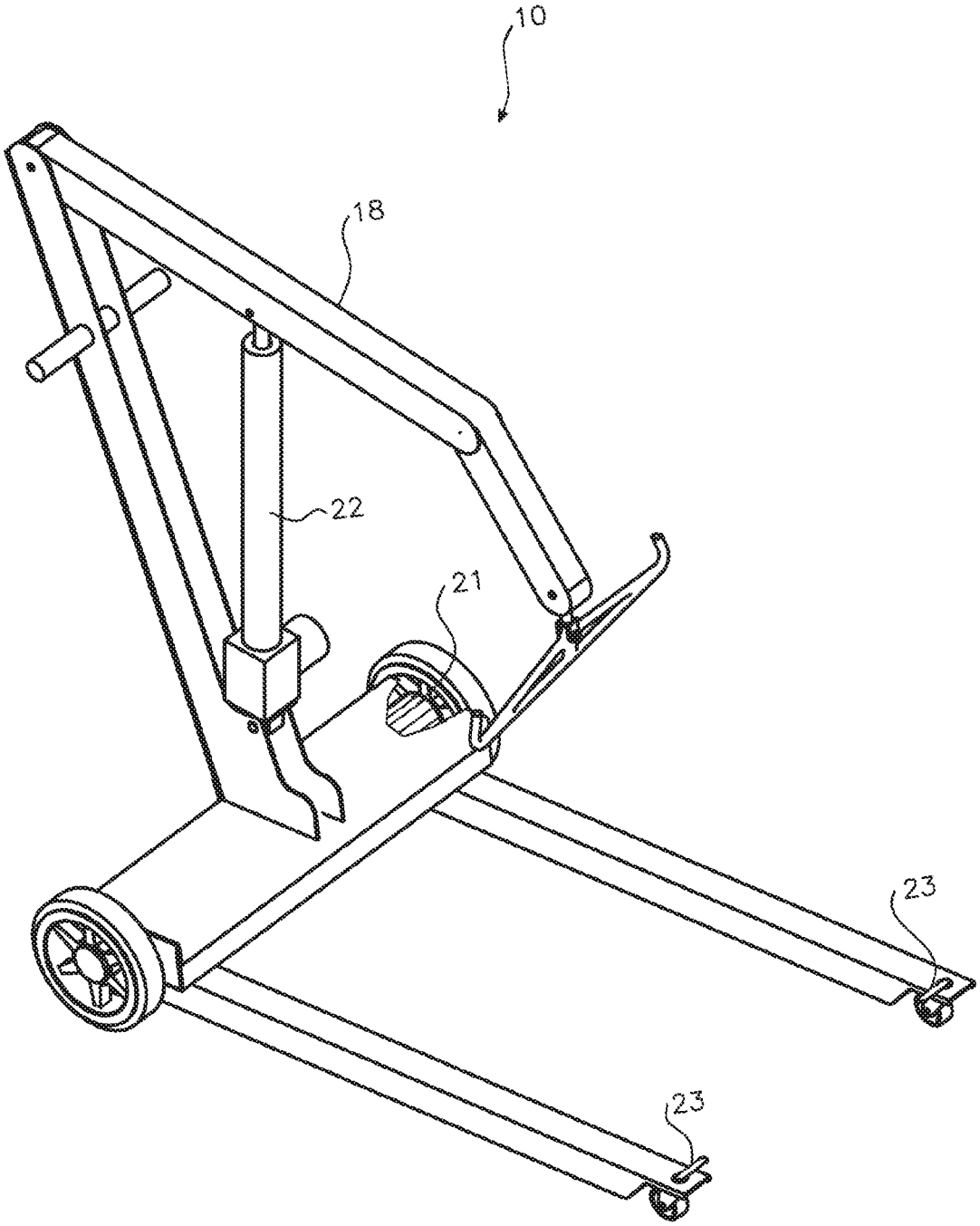
FIG. 2 is a further perspective view of the assembly of FIG. 1 with a lifting arm of the assembly in a lowered position.

A first portion 18 of the lifting arm 12 is pivotally attached to a second or fixed, upright portion 20, and is operable between a raised position (as shown in FIG. 1 and a lowered position as shown in FIG. 2 by a linear actuator 22.

Again with reference to FIG. 1, the outer end 24 of the piston rod 26 of the linear actuator 22 is pivotally connected to the first portion 18 of the lifting arm 12, while its lower end 28 of the linear actuator 22, is releasably mounted to the second or fixed, upright portion 20 of the lifting arm 12.

Figures 4, 4A:
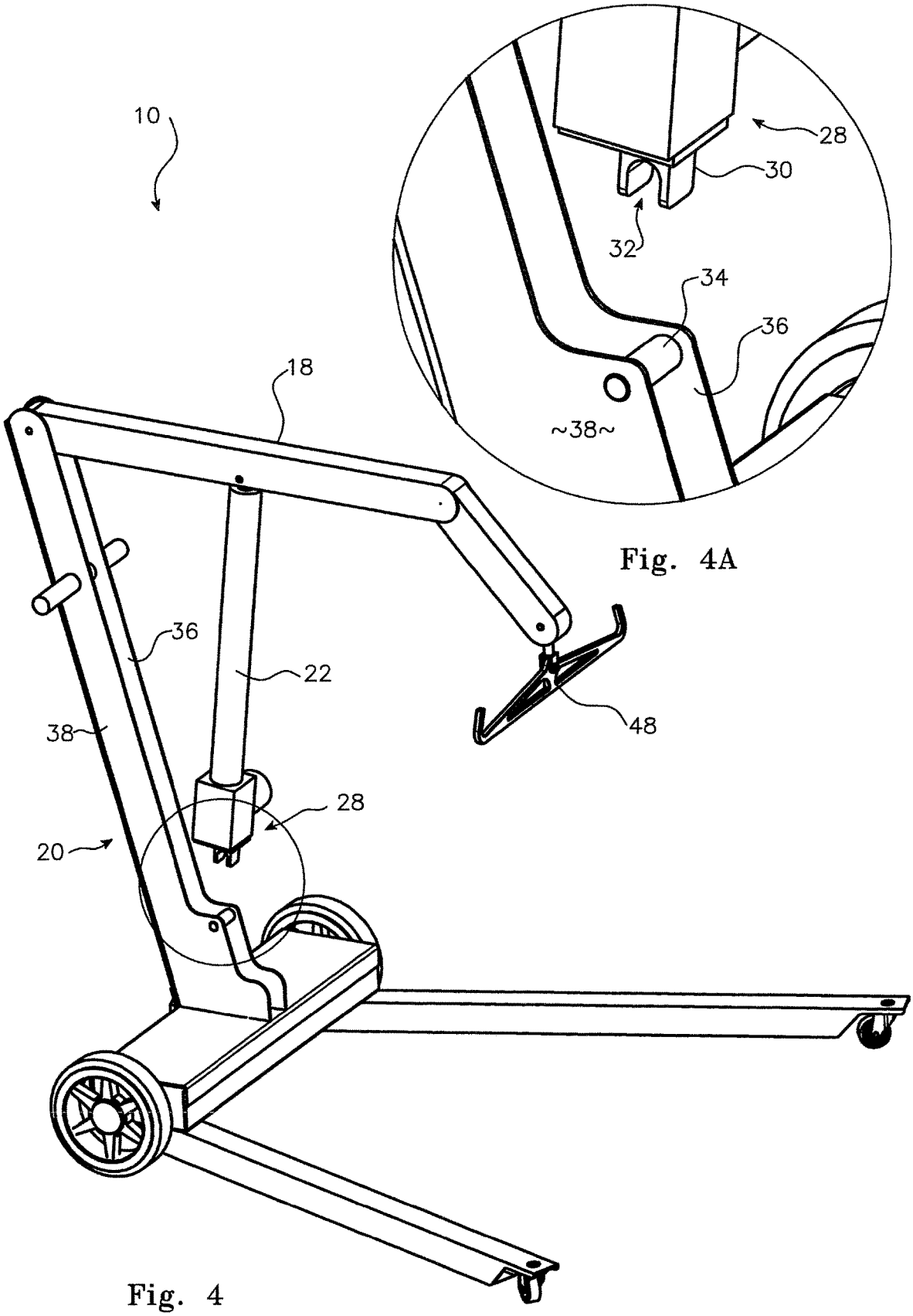
FIGS. 4 and 4A are perspective views of the assembly showing details of the mounting arrangement of crush avoidance system of FIG. 3, FIGS. 5 and 5A are a perspective views of the assembly showing a preferred way of mounting the lifting arm to a base structure of the assembly.

FIGS. 4 and 4A shows a preferred arrangement for the mounting of the lower end 28 of the linear actuator. The second or lower end 28 of the linear actuator 22 is provided with a mounting boss 30 to providing a first connecting element for releasable connection to a complementary second connecting element provided on the second or fixed, upright portion 20 of the lifting arm 12. The mounting boss 30 comprises a body provided with a transverse slot 32 while the complementary connecting element comprises a transverse support pin 34 mounted between side plates 36 and 38 forming the second or fixed, upright portion 20 of the lifting arm. The slot 32 slidingly engages with the transverse support pin 34 (as in FIG. 1) when the assembly 10 is in use for lifting and lowering a user.

Figure 3:
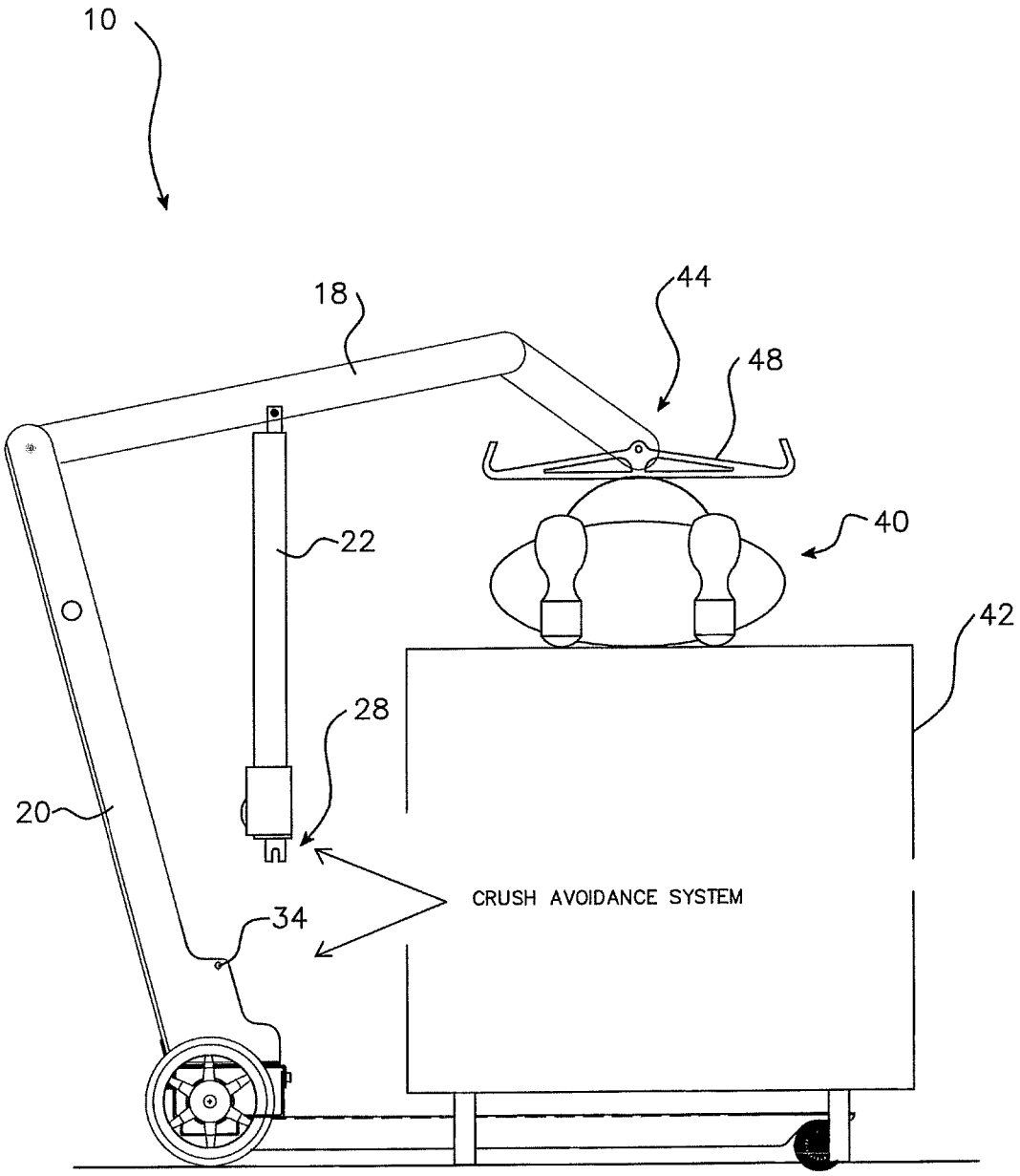
FIG. 3 is a side elevation view of a crush avoidance system of the assembly.

The releasable mounting of the second or lower end 28 of the linear actuator 22 provides a novel and inventive crush avoidance safety feature which prevents injury to the user if the linear actuator moves the first portion 18 of the lifting arm to an excessively lowered position as shown in FIG. 3, in which the first portion of the lifting may expose the user 40 to a dangerous crushing force. This may happen for example through inattention by a carer or through a malfunction of the control system.

In this situation in which the linear actuator 22 continues to retract and lower the second portion 18 of the lifting arm 12 when a user 40 is already resting on some support, such as a wheel chair or bed 42 for example, the end 44 of the arm will likely come into contact with the user. However, when the resulting upward force then acting on the end 44 of the first portion 18 of the lifting arm 12 exceeds the combined weight of the first portion 18 and that of the linear actuator 22, the downward force is disengaged by the lower end 28 of the actuator disengaging from its mounting. Thus the force of contact with the user in such a potentially injurious incident cannot exceed the combine weight of these components.

With reference again to FIG. 1, the base structure 14 of the assembly comprises a hollow body 50 provided at each outer end with a drive wheel 52 and 54. Preferably the hollow body is formed of two length of channel section, one forming a base portion 56 and the other a cover portion 58.

Each drive wheel 52 and 54 is driven by a respective electric motor 21 and gear train module (not shown) located within the hollow body 50. Preferably the gear trains are formed as a series of gear wheels and toothed belts to reduce the RPM of the electric motors to a predetermined RPM of the drive wheels. A rechargeable battery bank and electronic control module are also accommodated within the hollow body 50 of the base structure 14. Preferably the assembly's drive wheels and linear actuator are activated via a short range wired or wireless remote control.

The electric motors driving the wheels 52 and 54 are controllable for synchronized rotation of the wheels for forward and rearward movement of the assembly 10. They are also capable of contra-rotating the wheels for rotation of the assembly about a vertical axis. For safety reasons, the contra-rotation of the wheels can only be engaged when the assembly 10 is stationary. To prevent excessive swinging motion being imparted to a suspended user, the electronic control of the electric motors includes soft start and stop functionality.

Figures 5, 5A:
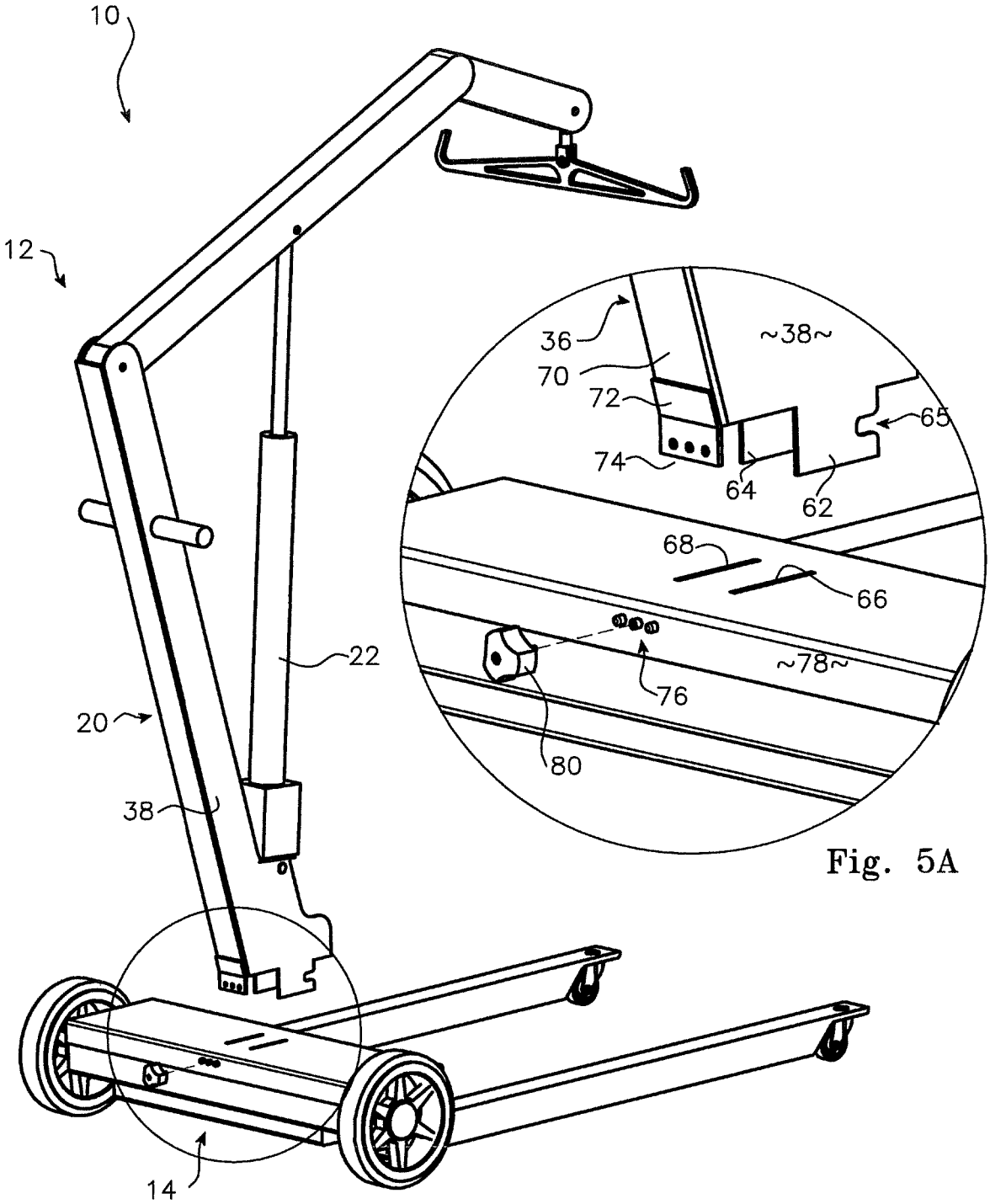

With reference now to FIGS. 5 and 5A, the articulated lifting arm 12 is mounted at the center of the base structure 14. The second or fixed, upright portion 20 of the lifting arm 12, is provided with connector elements 60 formed at the lower end of the side plates 36 and 38 which include tabs 62 and 64 provided with forwardly directed slots 65. These tabs 62 and 64 are inserted through slots 66,68 in the upper surface of the cover portion 58 of the hollow body of the support structure to allow the forwardly directed slots 65 of the connector elements 62 and 64 to engage with a transverse plate (not shown) mounted within the hollow body.

The rear surface 70 at the lower end of the second or fixed, upright portion 20 of the lifting arm 12 is provided with a securing plate 72, which extends below its lower edge and is provided with apertures 74 for engagement with pins 76 projecting from a rear surface 78 of the support structure 14. The center one of the projecting pins is provided with an externally threaded shaft adapted to receive an internally threaded securing knob 80 for locking the lifting arm in position on the base structure.

In one preferred arrangement, the electric motor of the linear actuator 22, may be provided with an extension mechanism (not shown) by means of which the motor shaft and gear drive of the actuator may be manually rotated. This allows the linear actuator to be urged into extension or retraction in the emergency situation of a power loss in the system.

With reference now again to FIGS. 1 and 6 the fork 16 of the assembly 10 comprises of two fork elements 82 and 84 extending from the base structure 14. Each outer end 86 and 88 of fork elements 82 and 84 is provided with a swiveling castor 90 and 92 respectively, which incorporate a locking system 23 for locking the direction of movement of the castor at a desired angle relative to a longitudinal axis of its respective fork element.

Each of the fork elements 82 and 84 is releasably and pivotally mounted to the base structure 14 and is arranged for rotation about a respective vertical axis 94 and 96, at the underside of the base structure 14. This allows each fork element to be rotatable between a first direction in which each fork element is parallel to the centerline 98 of the assembly (as shown in FIG. 1), and a second splayed direction wherein the separation between the outer ends 86 and 88 of the fork elements is greater than the separation of the vertical axes 94 and 96 at the base structure 14. The degree of movement of the fork elements between the parallel and splayed positions is controlled by stops (not shown) at the base structure 14.

Locking elements 23 provided for each fork element provide for locking the fork elements in either the parallel or splayed position.

Figure 6:
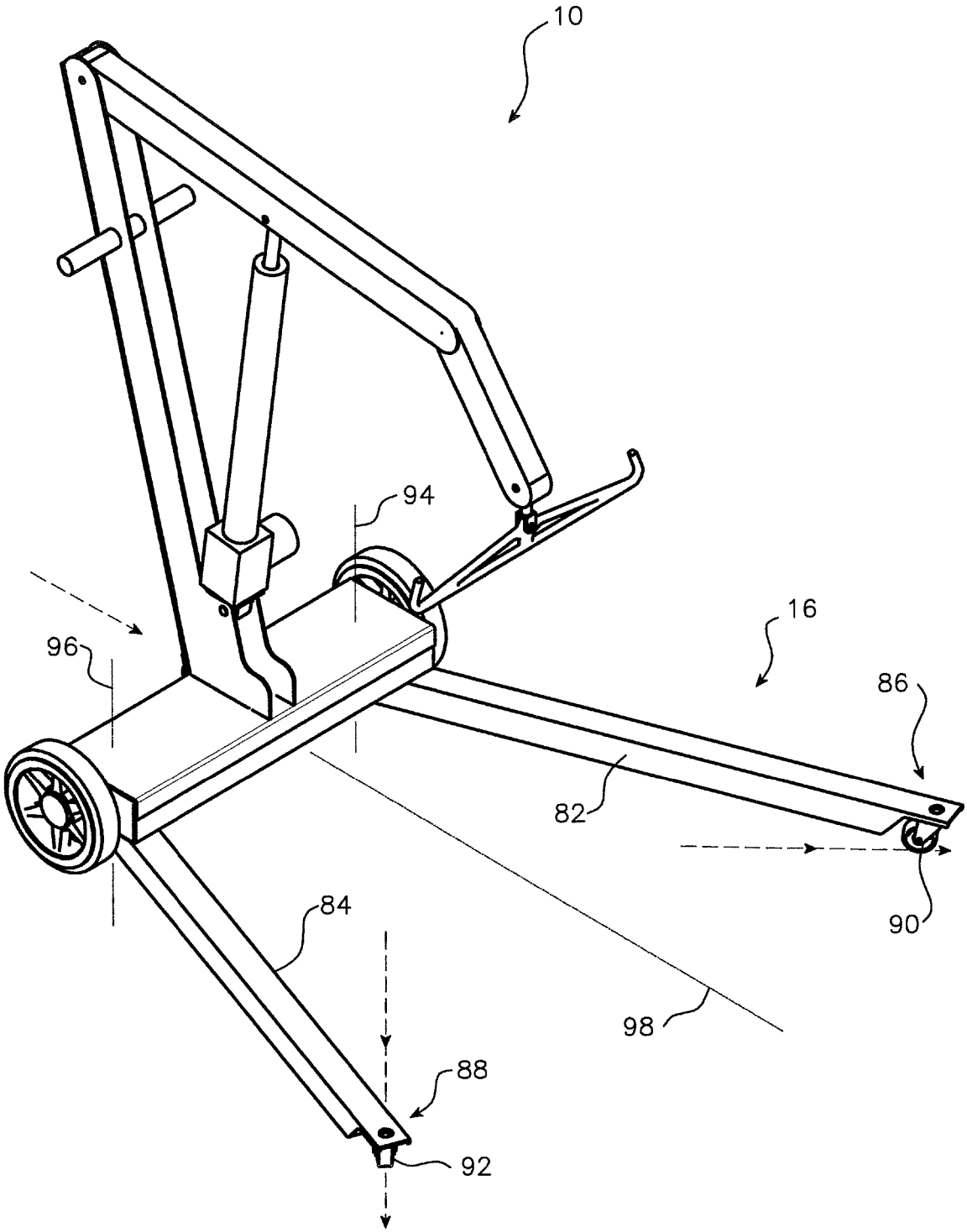
FIG. 6 is a perspective view of the assembly of FIG. 1 showing a splayed positions of the fork elements of the assembly.

To change the fork elements 82 and 84 from the parallel to the splayed position, the locking elements of the fork elements are unlocked. Each castor 90 and 92 is then manually rotated into an outward (or "toed out") facing direction as shown in FIG. 6, and locked at a suitable angle. The assembly is then driven in a forward direction for a short distance which causes the fork elements to spread outwardly due to the tracking of the castors 90 and 92. Reversing the assembly with the castors still rotated in the outward direction forces the fork elements back into the parallel position.

Alternatively, locking the castors into an inward pointing direction and driving the assembly in reverse, will rotate the fork elements from the parallel position into the splayed position, and it follows that with the castors in this position, forward movement of the assembly will return the splayed fork elements to the parallel position.

Figure 8:
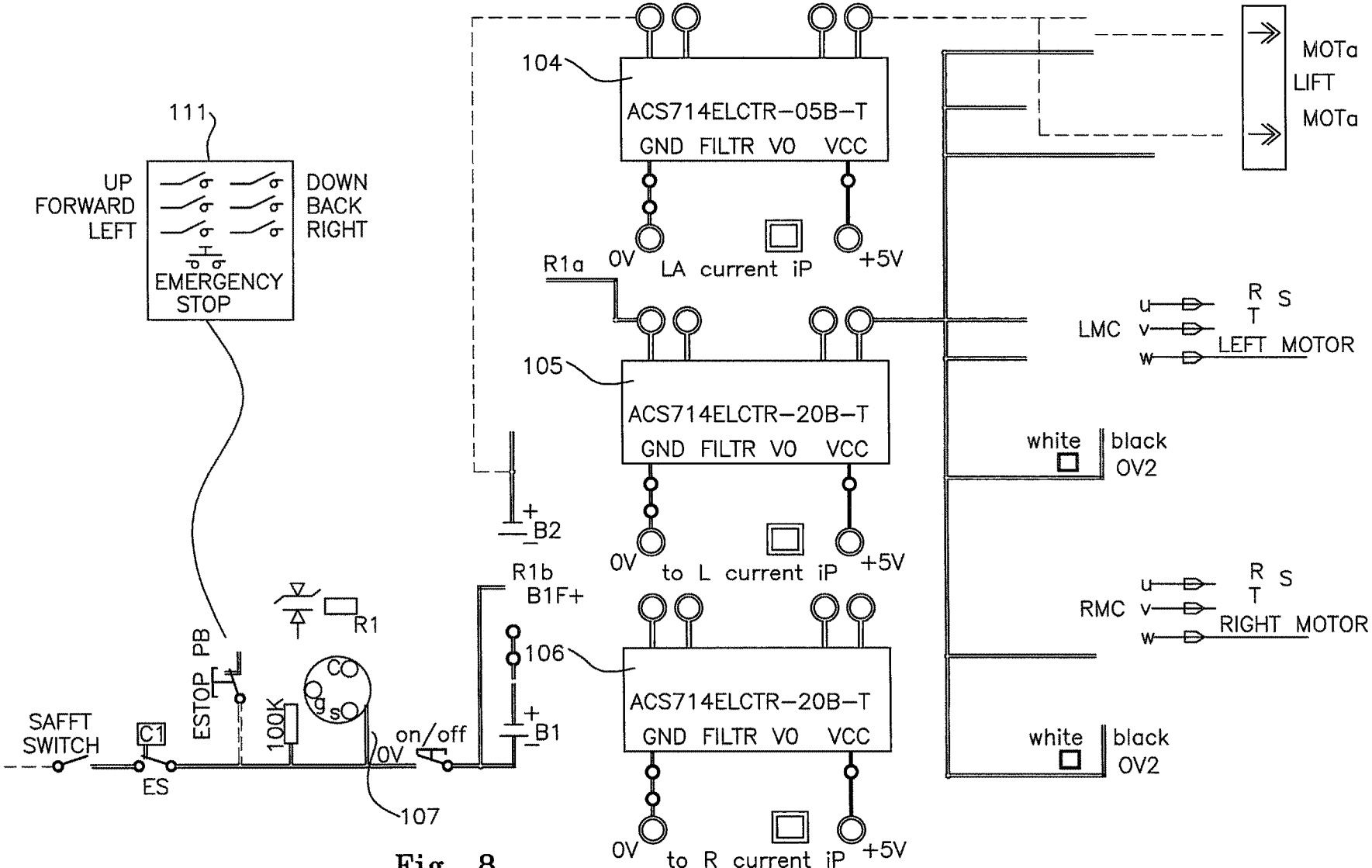
FIG. 8 illustrates an electronic block diagram of drive and control circuitry suitable to give effect to operation of the assembly illustrated in FIG. 6.

FIG. 8 illustrates an electronic block diagram of drive and control circuitry suitable to give effect to operation of the assembly illustrated in FIG. 6.

In a preferred form, a handheld controller unit 111 incorporates discrete push buttons for the following operations: up, down, forward, back, left, right and an emergency stop.

Figure 9:
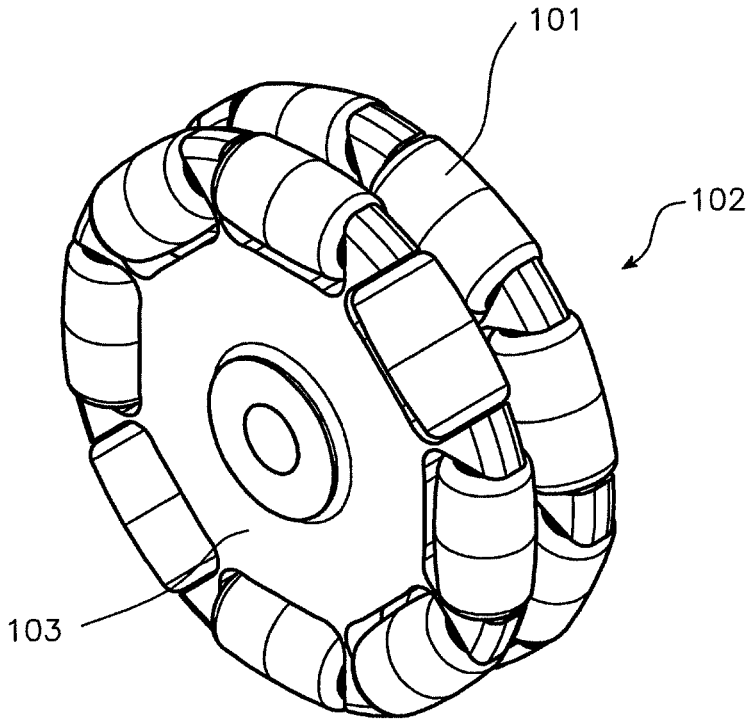
FIG. 9 is a perspective view of an alternative wheel structure which can be utilised with the assembly of FIG. 6.

FIG. 9 is a perspective view of an alternative wheel structure which can be utilized with the assembly of FIG. 6.

In this arrangement, separate control units 104, 105 and 106 are provided for the left wheel motor assembly (not shown) and the right wheel motor assembly 21 and for the lifter.

In preferred forms, the battery units may be switched 107 between series and parallel operation. In parallel operation, they drive the wheel assembly. In series operation, they drive the linear actuator of the lifter.

In this arrangement, ferrules 101 are mounted for rotation about the periphery 102 of a wheel 103. The rotation of the ferrules is about an axis in the plane of the wheel thereby assisting realignment of the wheel on various surfaces including dense carpet and the like.

Figure 10:
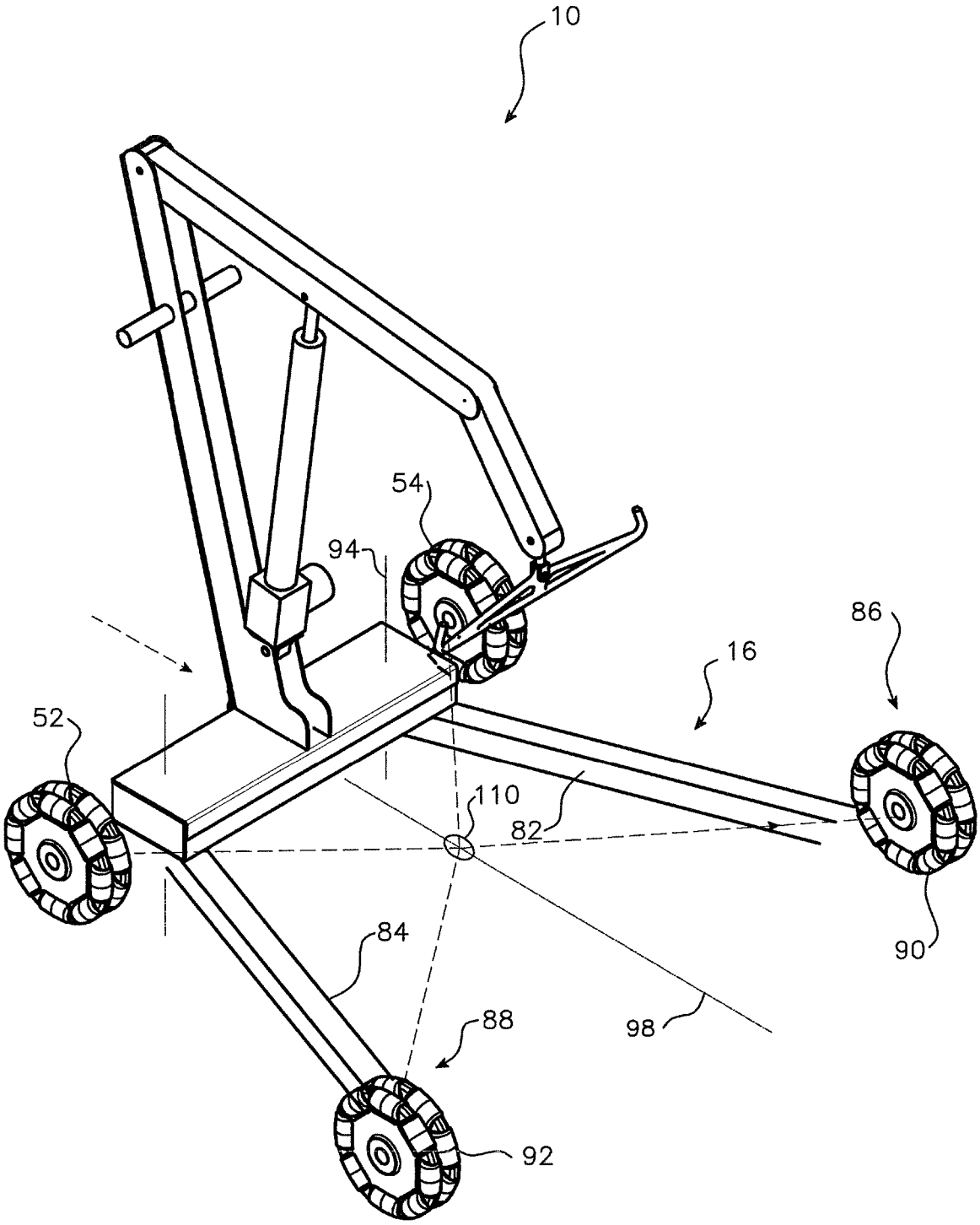
FIG. 10 is a perspective view of the entire assembly in accordance with a further preferred embodiment.

With reference to FIG. 10, there is illustrated a further preferred embodiment wherein like components are numbered as for the embodiment shown in FIG. 6.

In this instance, the drive wheels 52, 54 are replaced with the alternative wheel structure of FIG. 9. In addition, in a preferred form the lead wheels 90, 92 are also replaced with the alternative wheel structure of FIG. 9. In preferred forms, the wheels are aligned such that their axes of rotation are normally aligned at 45 degrees to the longitudinal axis 98 of the assembly 10. In a more particular preferred form their axes intersect at a common intersection point 110.

In a further particular preferred form the drive wheels 52,54 are affixed to the trailing ends of the legs 82,84. In this instance the drive motors may be located within the legs 82,84.

Similarly the lead wheels 90, 92 may be driven wheels with their respective drive motors preferably located within the legs 82,84.

In a further particular form the wheels may be mounted in pairs at the leading and trailing edges of the legs 82,84.

INDUSTRIAL APPLICABILITY

Figure 7:
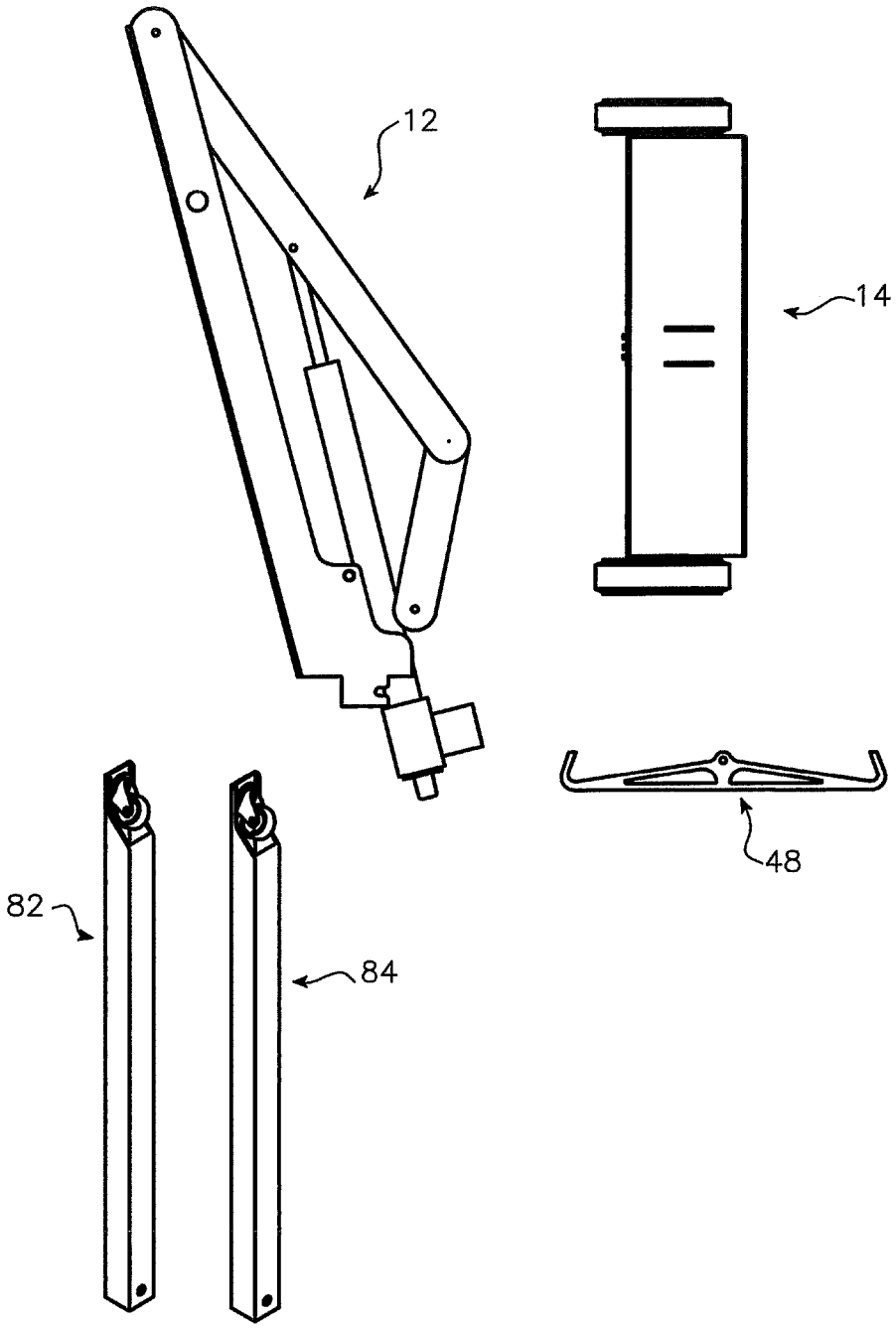
FIG. 7 is an exploded view of the assembly of FIGS. 1 to 6 indicating the components disassembled for transportation.

The construction of the disability aid assembly of the invention allows for simple and rapid disassembly of the components for packing into suitable luggage for transport. Thus as shown in FIG. 7 the components of the assembly 10 when disassembled, comprise the base structure 14, the lifting arm 12 folded as shown, the two fork elements 82 and 84 and the hanger 48.

Careful choice of materials and components such as the electric motors, gear trains, wheels and castors etc. allows for an all up weight of around 20 Kg making the device ideal for travel and use in hotel rooms for example.

The invention claimed is:

1. A mobility aid assembly for lifting and lowering a user comprising an articulated lifting arm releasably mounted to a base structure, wherein:

a first portion of the lifting arm is operable between a lowered position and a raised position by a linear actuator;

a first end of the linear actuator is configured to remain attached and pivotally connected to the first portion of the lifting arm; and, a second end of the linear actuator is provided with a mounting boss, the mounting boss is provided with a first connecting element for releasable connection to a complementary second connecting element provided on a second, fixed upright portion of the lifting arm, the first connecting element comprises a transverse U-shaped slot having parallel sides and the complementary second connecting element comprises a transverse pin, wherein the second end of the linear actuator is positioned to slidingly engage the transverse U-shaped slot with the transverse pin to slidingly releasably mount the second end of the linear actuator on the complementary second connecting element so as to avoid injury to the user if the linear actuator moves the first portion of the lifting arm to an excessively lowered position in which the first portion of the lifting arm impinges on the user, and wherein the second end of the linear actuator disengages from the complementary second connecting element when an upward force acting on the first portion of the lifting arm exceeds the combined weight of the first portion of the lifting arm and that of the linear actuator.

2. The assembly of claim 1 wherein the base structure comprises:

a hollow body having outer ends; and a drive wheel provided at each outer end, each drive wheel being driven by respective electric motor modules located within the hollow body.

3. The assembly of claim 2 wherein each electric motor is controllable for synchronized rotation of the wheels for forward and rearward movement of the assembly and for contra-rotation of the wheels for rotation of the assembly about a vertical axis.

4. The assembly of claim 1 further comprising a forwardly directed fork, the fork comprising two fork elements extending from the base structure, wherein:

each fork element includes an outer end;

each outer end is provided with a swiveling castor; and each castor is provided with a locking mechanism for locking the direction of movement of the castor at a desired angle relative to a horizontal centerline of the assembly.

5. The assembly of claim 4 wherein:

each fork element is releasably mounted to the base structure;

each fork element is arranged for rotation about a respective vertical axis at the base structure;

each fork element is rotatable between a first direction parallel to the horizontal centerline of the assembly and a second splayed direction; and a separation between the outer ends fork elements is greater than a separation of the vertical axes at the base structure.

6. The assembly of claim 5 wherein:

the fork elements move from the first direction parallel to the horizontal centerline to the splayed direction if the castor at each outer end fork element is locked at an outwardly splayed angle relative to a centerline of the respective fork element and the assembly is driven in a forward direction; and the fork elements return to the first direction when the assembly is driven in a rearward direction with the castors locked in the outwardly splayed angle.

7. A method of avoiding injury to a user of a disability aid assembly if a first articulated portion of a lifting arm of the assembly is lowered by a linear actuator of the assembly to a point at which the first articulated portion is driven into contact with the user by retraction of the linear actuator, the method comprising the steps of:

slidably engaging a transverse U-shaped slot located on a lower end of the linear actuator with a transverse pin located on a second, fixed upright portion of the lifting arm; wherein an outer end of the linear actuator is configured to remain attached and pivotally connected to the first articulated portion of the lifting arm; and disengaging the lower end of the linear actuator from the second, fixed portion of the lifting arm when a force cannot exceed a combined weight of the articulated portion of the lifting arm and the linear actuator.

8. A mobility aid assembly for lifting and lowering a user comprising an articulated lifting arm releasably mounted to a base structure, wherein:

a first portion of the lifting arm is operable between a lowered position and a raised position by a linear actuator;

a first end of the linear actuator is configured to remain attached and pivotally connected to the first portion of the lifting arm; and, a second end of the linear actuator is provided with a mounting boss, the mounting boss is provided with a first connecting element for releasable connection to a complementary second connecting element provided on a second, fixed upright portion of the lifting arm, the first connecting element comprises a transverse U-shaped slot having parallel sides and the complementary second connecting element comprises a transverse pin, wherein the second end of the linear actuator is positioned to slidingly engage the transverse U-shaped slot with the transverse pin to slidingly releasably mount the second end of the linear actuator on the complementary second connecting element so as to avoid injury to the user if the linear actuator moves the first portion of the lifting arm to an excessively lowered position in which the first portion of the lifting arm impinges on the user.

* * * * *